US006923382B2

(12) United States Patent
Augustin

(10) Patent No.: US 6,923,382 B2
(45) Date of Patent: Aug. 2, 2005

(54) HYDRAULICALLY ACTUATED INJECTOR WITH DELAY PISTON AND METHOD OF USING THE SAME

(75) Inventor: Ulrich Augustin, Blythewood, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 581 days.

(21) Appl. No.: 10/045,065

(22) Filed: Jan. 15, 2002

(65) Prior Publication Data

US 2002/0092921 A1 Jul. 18, 2002

Related U.S. Application Data

(60) Provisional application No. 60/261,810, filed on Jan. 17, 2001.

(51) Int. Cl.[7] ..... F02M 47/02; F02M 59/00; B05B 1/30

(52) U.S. Cl. ..... 239/88; 239/533.2; 239/533.3; 239/585.1; 239/585.5

(58) Field of Search ..... 239/88, 89, 90, 239/91, 92, 95, 127, 533.2, 533.3, 533.8, 533.9, 533.14, 585.1, 585.2, 585.3, 545.4, 585.5; 251/129.15, 129.21, 127

(56) References Cited

U.S. PATENT DOCUMENTS

| | | | |
|---|---|---|---|
| 3,392,715 | A | 7/1968 | Thoma |
| 4,367,706 | A | 1/1983 | Scheying |
| 4,811,899 | A | 3/1989 | Egler |
| 4,975,029 | A | 12/1990 | Hatz |
| 5,074,766 | A | 12/1991 | Kochanowski |
| 5,209,208 | A | 5/1993 | Siebert et al. |
| 5,492,098 | A | 2/1996 | Hafner et al. |
| 6,067,955 | A | 5/2000 | Boecking |
| 6,085,726 | A | 7/2000 | Lei et al. |

*Primary Examiner*—Davis Hwu
(74) *Attorney, Agent, or Firm*—McGuireWoods LLP

(57) ABSTRACT

An oil activated fuel injector which provides a pilot quantity of fuel prior to the main fuel injection event. The oil activated fuel injector includes a delay piston assembly in fluid communication with a high pressure chamber of the fuel injector. The pilot quantity of fuel flows through the delay piston during a pre stroke of the plunger. The oil activated fuel injector reduces engine emissions and noise, and eliminates the need for additional working fluid to be provided therein in order to provide a pilot quantity of fuel.

18 Claims, 2 Drawing Sheets

HYDRAULICALLY ACTUATED INJECTOR WITH DELAY PISTON AND METHOD OF USING THE SAME

CROSS REFERENCE TO RELATED APPLICATION

This application claims priority to U.S. provisional application Ser. No. 60/261,810, filed on Jan. 17, 2001.

BACKGROUND OF THE INVENTION

1. Field of the Invention

The present invention generally relates to an oil activated fuel injector and, more particularly, to an oil activated electronically or mechanically controlled fuel injector control with a delay piston and method of use.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In current designs, a driver will deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, a small quantity (pilot injection) of fuel cannot be efficiently injected into the engine during a pre-stroke phase of the plunger which leads to higher emissions and engine noise. The smaller quantities of fuel cannot be efficiently injected into the engine because once the solenoid valve of the injector is opened a larger quantity of fuel is injected into the engine. To provide a smaller quantity of fuel, a delay of the pre-stroke of the plunger must be provided. But, this can only be provided in the conventional system by adding more working fluid, under high pressure, into the injector. The additional pressurized working fluid may cause a delay; however, additional energy from the high pressure oil pump must be expanded in order to provide this additional working fluid. This leads to an inefficiency in the operations of the fuel injector, itself, and also does not provide a consistent supply of fuel into the engine.

The present invention is directed to overcoming one or more of the problems as set forth above.

SUMMARY OF THE INVENTION

In a first aspect of the present invention, a fuel injector includes a spool slidable between a first position and a second position and an intensifier body positioned proximate to the spool. A compression assembly, which preferably includes a piston, plunger and spring mechanism, is slidably positioned within the intensifier body for compressing fuel in a high pressure chamber. A delay piston assembly is formed between the high pressure chamber and fuel bores for metering fuel between the high pressure chamber and injection nozzles.

In embodiments, the delay piston assembly includes a bore in fluid communication with the high pressure chamber and a delay piston positioned within the bore. A biasing spring is disposed within the bore and biases the delay piston in a first position. A groove is formed within the disk and surrounds a portion of the delay piston. A channel and outlet throttle in fluid communication with the bore allows fuel to spill to ambient. The delay piston allows a pilot quantity of fuel to be injected into a combustion chamber of an engine during a pre stroke phase of the compression assembly which, in embodiments, is approximately one cubic millimeter. The delay piston may also prevent fuel from flowing through the groove and into the fuel bore.

In another aspect of the present invention, a delay piston is provided. The delay piston includes a body having an upper surface and a lower surface and a fuel bore extending between the upper surface and the lower surface. A piston bore is in fluid communication with the fuel bore. A biasing spring is positioned within the piston bore and a piston is moveable between a first position and a second position and is also positioned within the piston bore. The biasing spring biases the piston in the first position and a groove surrounds the piston bore and is in fluid communication with the fuel bore. The piston partially overlaps the groove when the piston is in the second position.

In another embodiment, a method of providing a pilot quantity of fuel into a combustion chamber of an engine during a pre-stroke phase of a fuel injector is provided. This method includes providing fuel into a high pressure chamber of an intensifier body of the fuel injector and shifting a spool from a start position to an open position thereby allowing pressurized fluid to push a piston and plunger assembly downwards towards the high pressure chamber. The method further includes compressing the fuel within the high pressure chamber such that a piston moves from a first position to a second position. This allows a pilot quantity of fuel to pass from the high pressure chamber to a fuel nozzle and past the piston assembly when a piston of the piston assembly is moved to the second position.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to an oil activated electronically, mechanically or hydraulically controlled fuel injector which is capable of providing a pilot injection of fuel into the combustion chamber of an engine. In embodiments, approximately, one cubic millimeter of fuel should be injected into the combustion chamber using the present invention. This small quantity of fuel (pilot injection) is injected into the engine prior to the main injection event. The oil activated fuel injector of the present invention will thus increase efficiency of the injection cycle and decrease engine noise and engine emissions, and eliminate the need for additional working fluid to be provided in order to provide a pilot quantity of fuel.

Embodiments of the Oil Activated Fuel Injector of the Present Invention

Figure 1:
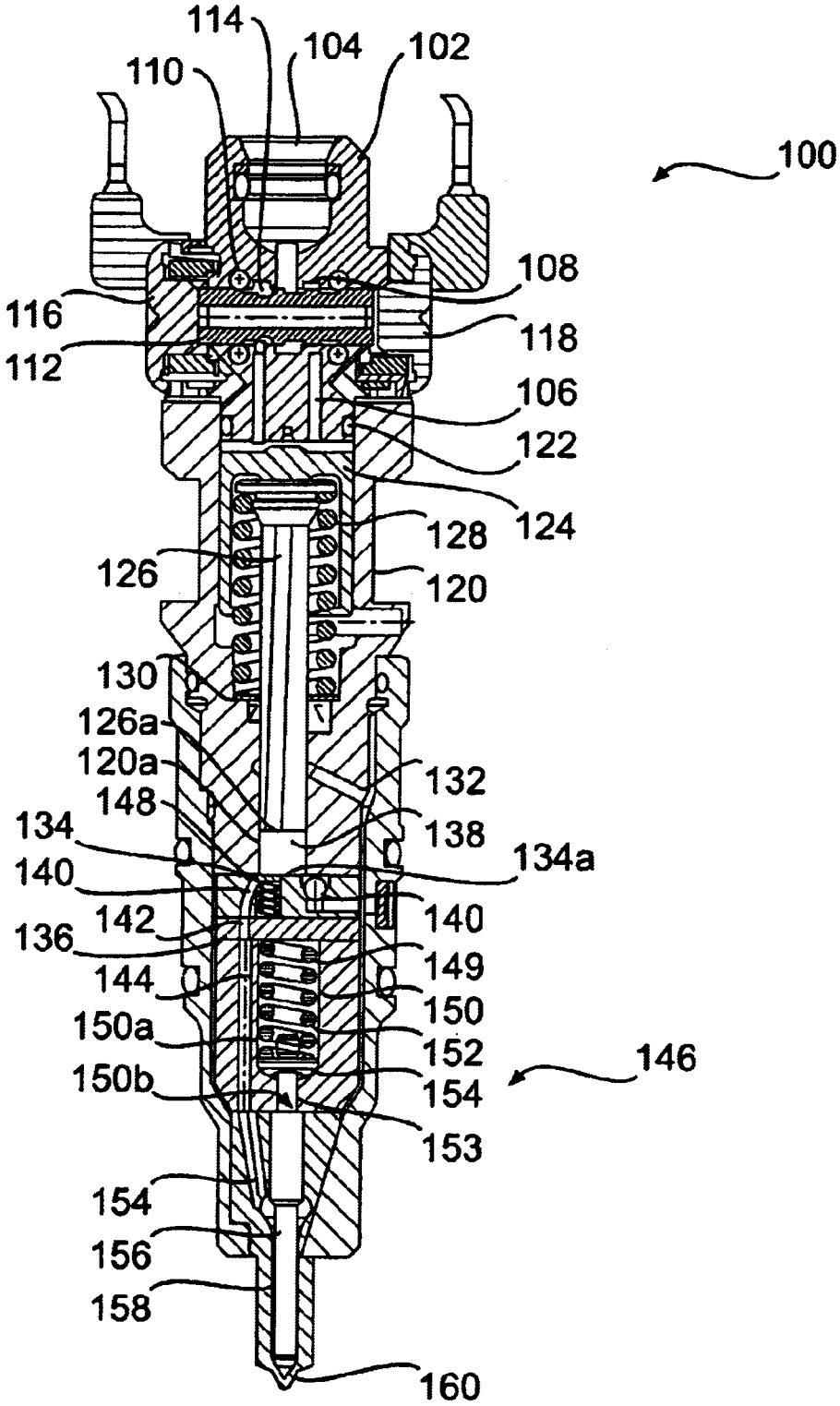
FIG. 1 shows an oil activated fuel injector of the present invention.

Referring now to FIG. 1, an overview of the fuel injector of the present invention is shown. The fuel injector is generally depicted as reference numeral 100 and includes a control valve body 102 as well as an intensifier body 120 and a nozzle 146. The control valve body 102 includes an inlet area 104 which is in fluid communication with working ports 106. At least one groove or orifice (hereinafter referred to as grooves) 108 is positioned between and in fluid communication with the inlet area 104 and the working ports 106. At least one of vent hole 110 (and preferably two ore more) is located in the control body 102 which is in fluid communication with the working ports 106.

A spool 112 having at least one groove or orifice (hereinafter referred to as grooves) 114 is slidably mounted within the control valve body 102. An open coil 116 and a closed coil 118 are positioned on opposing sides of the spool 112 and are energized via a driver (not shown) to drive the spool 112 between a closed position and an open position. In the open position, the grooves 114 of the spool 112 are aligned with the grooves 108 of the valve control body 102 thus allowing the working fluid to flow between the inlet area 104 and the working ports 106 of the control valve body 102.

Still referring to FIG. 1, the intensifier body 120 is mounted to the valve control body 102 via any conventional mounting mechanism. A seal 122 (e.g., o-ring) may be positioned between the mounting surfaces of the intensifier body 120 and the control valve body 102. A piston 124 is slidably positioned within the intensifier body 120 and is in contact with an upper end of a plunger 126. An intensifier spring 128 surrounds a portion (e.g., shaft) of the plunger 126 and is further positioned between the piston 124 and a flange or shoulder 130 formed on an interior portion of the intensifier body 120. The intensifier spring 128 urges the piston 122 and the plunger 126 in a first position proximate to the control valve body 102. A pressure release hole 132 may be formed in the body of the intensifier body 120.

As further seen in FIG. 1, a first disk 134 and a second disk 136, respectively, are positioned below the intensifier body 120 remote from the valve control body 102. The combination of an upper surface 134*a* of the first disk 134, an end portion 126*a* of the plunger 126 and an interior wall 120*a* of the intensifier body 120 forms a high pressure chamber 138. A fuel inlet check valve 140 is positioned within the disk 134, in embodiments, and provides fluid communication between the high pressure chamber 138 and a fuel area (not shown). This fluid communication allows fuel to flow into the high pressure chamber 138 from the fuel area during an up-stroke of the plunger 126. The pressure release hole 130 is also in fluid communication with the high pressure chamber 138 when the plunger 126 is urged into the first position; however, fluid communication is interrupted when the plunger 126 is urged downwards towards the disk 134. The disk 134 also includes a fuel bore 140 in fluid communication with a fuel bore 142 of the disk 136 and a fuel bore 144, respectively, of the of the nozzle 146. The disk 134 also includes a delay piston assembly generally depicted as reference numeral 148, which includes a return spring and piston within a bore and other elements as discussed in more detail with reference to FIGS. 2–4.

FIG. 1 further shows the nozzle 146 and a spring cage 149 The spring cage 149 is positioned between the nozzle 146 and the disk 136, and includes the fuel bore 144 in fluid communication with the fuel bore 142 of the disk 136. The spring cage 149 also includes a centrally located bore 150 having a first bore diameter 150*a* and a second smaller bore diameter 150*b*. A spring 152 and a spring seat 154 are positioned within the first bore diameter 150*a* of the spring cage 149, and a pin 153 is positioned within the second bore 150*b*.

The nozzle 146 includes a bore 154 in fluid alignment with the bore 144. A needle 156 is preferably centrally located with the nozzle 146 and is urged downwards by the spring 152. A fuel chamber 158 may surround the needle 156 and is in fluid communication with the bore 154. In embodiments, a heart chamber 160 surrounds the needle 156. As thus seen in FIG. 1, fluid communication can be accomplished between the high pressure chamber 138 and an injection nozzle 160 via the delay piston assembly 148, bores 140, 142, 144, 154 and the fuel chamber 158.

Figure 2:
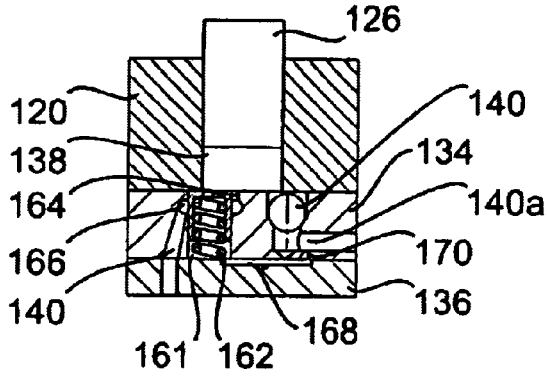
FIG. 2 shows an exploded view of a delay piston used with the oil activated fuel injector.

FIG. 2 shows an exploded view of the delay piston assembly. Specifically, the delay piston assembly includes a return or biasing spring 162 and a delay piston 164 disposed within a bore 161. The biasing spring 162 urges the delay piston 164 into a first position proximate to the intensifier body 120, preferably in contact therewith. The bore 161 is in fluid communication with the high pressure chamber 138 and the bore 140. A groove 166 surrounds the bore 161 and partially overlaps a portion of the delay piston 164 and is thus in fluid communication with the high pressure chamber 138 and the bore 140 in the first disk 134. In the first position, the delay piston will present fuel from entering the groove 166 and this preventing the fuel from entering the fuel bores. However, in a second position, the delay piston 164 overlaps, in embodiments, partially with the groove 166 thus providing fluid communication between the high pressure chamber 138 and the fuel bore 140. A channel 168 and outlet throttle 170 are in fluid communication with the bore 161 (and hence the delay piston 164) which allows the fuel to spill to ambient via a channel 140*a* of the fuel inlet check valve 140. In the start or initial position, the top of the delay piston 164 contacts the intensifier body.

Figure 3:
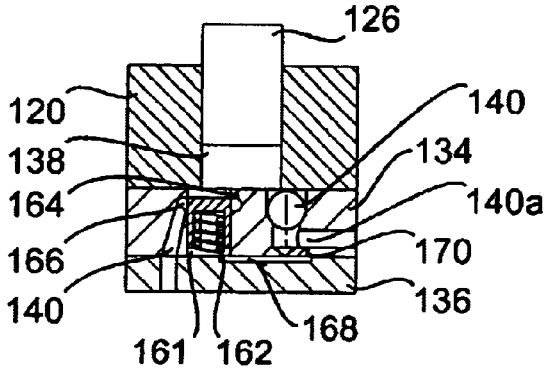
FIG. 3 shows an exploded view of a delay piston after SOI (Define SOI)
Figure 4:
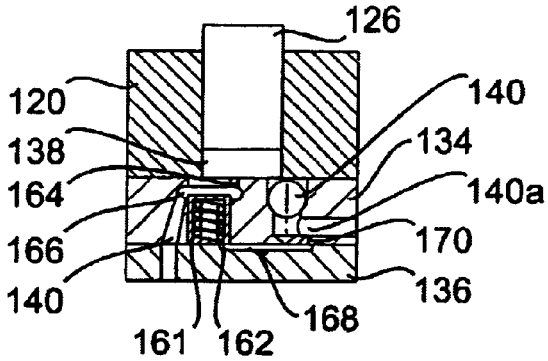
FIG. 4 shows an exploded view of a delay piston in the lowest position.

FIG. 3 shows the position of the delay piston 164 after SOI. In this position, the return spring 162 begins to compress due to the pressure of the fuel within the high pressure chamber. In FIG. 4, the delay piston 164 is in its lowest position such that the fuel from the high pressure chamber 138 can flow into the bore 140 via the groove 166. In this position, fuel captured within the bore 161 below the delay piston 164 can also flow to ambient via the channel 168 and outlet throttle 170. By using this mechanism, a small quantity of fuel (pilot quantity) can now be efficiently injected into the engine during a pre-stroke phase of the plunger assembly.

Operation of the Oil Activated Fuel Injector of the Present Invention

In operation, a driver (not shown) will first energize the open coil 116. The energized open coil 116 will then shift the spool 112 from a start position to an open position. In the open position, the grooves 108 of the control valve body 102 will become aligned with the grooves 114 on the spool 112. The alignment of the grooves 108 and 114 will allow the pressurized working fluid to flow from the inlet area 104 to the working ports 106 of the control valve body 102.

Once the pressurized working fluid is allowed to flow into the working ports 106 it begins to act on the piston 124 and the plunger 126. That is, the pressurized working fluid will begin to push the piston 124 and the plunger 126 downwards thus compressing the intensifier spring 128. As the piston 124 is pushed downward, fuel in the high pressure chamber will begin to be compressed via the end portion 126*a* of the plunger. A small quantity of compressed fuel will force the delay piston 164 and the spring 162 downwards. The delay piston 164 will then overlap with the groove 166 so that a pilot quantity of fuel can be supplied to the nozzle for injection into the combustion chamber of the engine, via the injection nozzle. In embodiments, approximately one cubic millimeter of fuel will be injected via this mechanism such that a reduction in emissions and engine noise will result, and a greater efficiency will be achieved by the fuel injector of the present invention.

As the pressure increases, the plunger 126 will be pushed further downward until an injection quantity of fuel is supplied to the engine. In this position, as the pressure increases, the fuel pressure will rise above a needle check valve opening pressure until the needle spring 149 is urged upwards. At this stage, the injection holes are open in the nozzle thus allowing a main fuel quantity to be injected into the combustion chamber of the engine.

To end the injection cycle, the driver will energize the closed coil 118. The magnetic force generated in the closed coil 118 will then shift the spool 112 into the closed or start position which, in turn, will close the working ports 106 of the control valve body 102. That is, the grooves 108 and 114 will no longer be in alignment thus interrupting the flow of working fluid from the inlet area 104 to the working ports 106. At this stage, the needle spring 152 will urge the needle downward towards the injection holes of the nozzle thereby closing the injection holes. Also, the intensifier spring 128 urges the plunger 126 and the piston 124 into the closed or first position adjacent to the valve control body 102. As the plunger 126 moves upward, the delay piston 164 will also move upwards via the force of the spring 162. At this position, the delay piston will prevent fuel from entering the groove 166. Any fuel remaining within the bore 161 will be released to ambient via the channel 168 and outlet throttle 170.

While the invention has been described in terms of preferred embodiments, those skilled in the art will recognize that the invention can be practiced with modification within the spirit and scope of the appended claims.

What is claimed is:

1. A fuel injector, comprising:

a spool slidable between a first position and a second position;

an intensifier body positioned proximate to the spool;

a compression assembly means slidably positioned within the intensifier body for compressing fuel in a high pressure chamber;

fuel passageway means for supplying fuel to a fuel nozzle; and a delay piston assembly formed between the high pressure chamber and the fuel passageway means for metering a pilot quantity of fuel between the high pressure chamber and the fuel passageway means.

2. The fuel injector of claim 1, further comprising a first disk in fluid communication with the high pressure chamber and a second disk contacting the first disk.

3. The fuel injector of claim 2, wherein the delay piston assembly is positioned within at least the first disk.

4. The fuel injector of claim 2, wherein a combination of an upper surface of the first disk, an end portion of the compression assembly means and an interior wall of the intensifier body forms the high pressure chamber.

5. The fuel injector of claim 2, further comprising a groove positioned about the delay piston assembly within the first disk.

6. The fuel injector of claim 2, wherein the first disk and the second disk include fuel bores in fluid communication with the nozzle and the delay piston assembly.

7. A fuel injector, comprising:

a spool slidable between a first position and a second position:

an intensifier body positioned proximate to the spool;

a compression assembly means slidably positioned within the intensifier body for compressing fuel in a high pressure chamber;

fuel passageway means for supplying fuel to a fuel nozzle; and a delay piston assembly formed between the high pressure chamber and the fuel passageway means for metering fuel between the high pressure chamber and the fuel passageway means, wherein the delay piston assembly includes:

a bore in fluid communication with the high pressure chamber;

a delay piston positioned within the bore;

a biasing spring disposed within the bore and which biases the delay piston in a first position; and a groove formed within the disk and surrounding a portion of the delay piston.

8. The fuel injector of claim 7, further comprising a channel and outlet throttle in fluid communication with the bore, the channel and the outlet throttle allowing fuel to spill to ambient.

9. The fuel injector of claim 7, wherein the delay piston allows a pilot quantity of fuel to be injected into a combustion chamber of an engine during a pre stroke phase of the compression assembly means.

10. The fuel injector of claim 9, wherein the pilot quantity of fuel is approximately one cubic millimeter which is allowed to pass through the groove when the delay piston is in the first position.

11. The fuel injector of claim 10, wherein the delay piston contacts the intensifier body in the first position.

12. The fuel injector of claim 11, wherein the delay piston prevents fuel from flowing through the groove and into the fuel passageway means from the high pressure chamber when the delay piston is in the first position.

13. The fuel injector of claim 10, wherein the delay piston compresses the biasing spring and permits fuel to flow through the groove and into the fuel passageway means from the high pressure chamber when the delay piston is in the second position.

14. A fuel injector, comprising:

a spool slidable between a first position and a second position;

an intensifier body positioned proximate to the spool;

a compression assembly means slidably positioned within the intensifier body for compressing fuel in a high pressure chamber;

fuel passageway means for supplying fuel to a fuel nozzle; and a delay piston assembly formed between the high pressure chamber and the fuel passageway means for metering fuel between the high pressure chamber and the fuel passageway means, wherein the delay piston assembly compresses the biasing spring and overlaps with the groove when the delay piston is in a second position remote from the first position.

15. A delay piston for a fuel injector, comprising:

a body having an upper surface and a lower surface;

a fuel bore extending between the upper surface and the lower surface;

a piston bore in fluid communication with the fuel bore;

a biasing spring positioned within the piston bore;

a piston moveable between a first position and a second position and positioned within the piston bore, the biasing spring biasing the piston in the first position; and a groove surrounding the piston bore and in fluid communication with the fuel bore, the piston partially overlapping the groove when the piston is in the second position.

16. The delay piston of claim 15, wherein the piston partially completely overlaps the groove when the piston is biased towards the first position.

17. A method of providing a pilot quantity of fuel into a combustion chamber of an engine during a pre-stroke phase of a fuel injector, comprising the steps of:

providing fuel into a high pressure chamber of an intensifier body of the fuel injector;

shifting a spool from a start position to an open position thereby allowing pressurized fluid to push a piston and plunger assembly downwards towards the high pressure chamber;

compressing the fuel within the high pressure chamber such that a piston assembly, positioned proximate to the high pressure chamber, moves from a first position to a second position;

allowing a pilot quantity of fuel to pass from the high pressure chamber to a fuel nozzle and past the piston assembly when a piston of the piston assembly is moved to the second position.

18. The method of claim 17, further allowing fuel to flow to ambient when the piston assembly is moved between the first position and the second position.

* * * * *